US006252558B1

(12) United States Patent
Brown et al.

(10) Patent No.: US 6,252,558 B1
(45) Date of Patent: Jun. 26, 2001

(54) MICROWAVE TRANSMIT/RECEIVE DEVICE WITH LIGHT POINTING AND TRACKING SYSTEM

(75) Inventors: Kenneth W. Brown, Yucaipa; James R. Gallivan, Pomona, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/507,531

(22) Filed: Feb. 18, 2000

(51) Int. Cl.[7] ..... H01Q 13/00
(52) U.S. Cl. ..... 343/781 R; 343/757
(58) Field of Search ..... 343/781, 781 R, 343/781 P, 781 CA, 757, 840, 700 MS, 909, 725, 729, 720, 753, 772, 786

(56) References Cited

U.S. PATENT DOCUMENTS

| | | | | |
|---|---|---|---|---|
| 4,260,993 | * | 4/1981 | Aubry et al. | 343/779 |
| 5,041,840 | * | 8/1991 | Cipolla et al. | 343/725 |
| 5,130,718 | * | 7/1992 | Wu et al. | 343/781 CA |
| 5,214,438 | * | 5/1993 | Brusgard et al. | 343/725 |
| 5,327,149 | * | 7/1994 | Kuffer | 343/720 |
| 5,451,969 | * | 9/1995 | Toth et al. | 343/781 CA |

* cited by examiner

*Primary Examiner*—Don Wong
*Assistant Examiner*—Chuc Tran

(57) ABSTRACT

A microwave antenna and light tracking system includes a microwave antenna, a microwave source, a light sensor, and a beam-guide system. The beam-guide system has a mirror set with at least one guide microwave mirror operable to guide a microwave beam along a first portion of a microwave path toward the antenna. Each microwave mirror has embedded therein a light mirror positioned to direct a light beam along a first portion of a light path substantially coincident with the first portion of the microwave path but in a reverse direction from the antenna. The beam-guide system further includes a dichroic beam splitter including a dichroic beam splitter microwave mirror having a light-transparent window therethrough. The dichroic beam splitter is disposed in a second portion of the microwave path between the mirror set and the microwave transmit/receive device and in a second portion of the light path between the mirror set and the light sensor. The microwave source is positioned to direct a microwave signal to the dichroic beam splitter, whereupon the microwave signal is reflected along the second portion of the microwave path to the mirror set and thence to the antenna. The light sensor is positioned to receive light transmitted along the second portion of the light path through the light-transparent window of the dichroic beam splitter.

17 Claims, 3 Drawing Sheets

MICROWAVE TRANSMIT/RECEIVE DEVICE WITH LIGHT POINTING AND TRACKING SYSTEM

BACKGROUND OF THE INVENTION

This invention relates to microwave systems, and, more particularly, to a microwave transmit/receive device having a light-based pointing and tracking system.

In one type of microwave device, a microwave signal is generated and propagated from a microwave feed horn along a microwave path. The microwave signal is reflected from a set of microwave mirrors, to a microwave antenna. The microwave antenna may be pointed in a selected direction to propagate the microwave signal in that direction as a microwave output beam. Additionally, the direction of propagation of the microwave output beam may be fine-tuned by tilting one or more of the mirrors of the microwave mirror set to redirect the microwave path prior to its reaching the antenna.

This type of microwave device is often used when there is a requirement for a high microwave power output. An example is the Deep Space Network used to send and receive communications signals to spacecraft that are far away from earth. In such a system, the large, heavy microwave feed horn and transmitter need not be pointed, but instead remain stationary with its output microwave signal directed to the antenna using the microwave mirror set, where it is directed into space. Another example is a portable microwave system which may be aligned and aimed optically.

In this type of microwave system, misalignment of the microwave beam propagated from the antenna results from any misalignment of the microwave mirror set. That is, if one or more of the microwave mirrors are assembled in a misaligned state or becomes misaligned during service, due to temperature fluctuations, mechanical shocks, or other reasons, the microwave output beam does not point exactly in the desired direction. This is particularly a problem for mobile microwave systems that are repeatedly disassembled, moved, and reassembled in another location, both because the components are desirably less massive and stable than in a stationary microwave system, and because there may be insufficient time and capability to adjust and align the system properly each time it is assembled.

There is a need for an approach by which microwave systems using a microwave mirror set may be readily pointed, tracked, and adjusted. The present invention fulfills this need, and further provides related advantages.

SUMMARY OF THE INVENTION

The present invention provides a microwave transmit/receive device with an integrated light pointing and tracking system. The light pointing and tracking system permits pointing of the microwave device to be compensated for errors in mirror alignment, which may arise upon assembly or in service. The result is precise aiming of the microwave output beam.

In accordance with the invention, a microwave antenna and light tracking system comprises a microwave antenna at a first end of a microwave path and at a first end of a light path, a microwave transmit/receive device at a second end of the microwave path, a light transmit/receive device at a second end of the light path, and a beam-guide system disposed in the microwave path and in the light path. The beam-guide system comprises a mirror set comprising at least one guide microwave mirror operable to direct a microwave beam along a first portion of the microwave path. Each microwave mirror has associated therewith (preferably embedded therein) a light mirror positioned to direct a light beam along a first portion of the light path substantially coincident with the first portion of the microwave path. The beam-guide system further includes a dichroic beam splitter disposed in a second portion of the microwave path between the mirror set and the microwave transmit/receive device, so that a second portion of the microwave path is reflected from the microwave beam-splitter mirror. The dichroic beam splitter is also disposed in a second portion of the light path between the mirror set and the light transmit/receive device, so that the second portion of the light path is transmitted through the dichroic beam splitter.

In this approach, the light path is substantially coincident with the microwave path, along the first portion of the light path and microwave path. Any misalignments in the microwave mirror(s) that affect the microwave path also affect the light beam. By compensating for the misalignment in the light beam, the misalignment and pointing error of the microwave beam is also compensated.

In a preferred embodiment, the microwave transmit/receive device is a microwave source such as a microwave horn, and a microwave output beam is propagated out of the antenna. The light transmit/receive device is a light sensor. The light sensor "sees" the same target region toward which the microwave output beam is directed. The microwave output beam may thereby be pointed in the desired direction.

The approach of the invention may be used with a microwave transmitter and/or receiver, and with a light transmitter and/or receiver, in any combination. For example, the microwave transmitter/receiver may include a microwave receiver for receiving signals from a target region viewed by the light sensor, in addition to or instead of the microwave source. The light transmitter/receiver may include a light source such as a laser designator, as well as the light sensor which receives the laser signal back from the target region. The microwave path and the light path are reciprocal, permitting microwave and light signals to travel in either direction.

In one application, the mirror set comprises at least four microwave waveguide mirrors, including a first microwave mirror adjacent to the dichroic beam splitter along the first portion of the microwave path, a second microwave mirror adjacent to the first mirror along the first portion of the microwave path, a third microwave mirror adjacent to the second microwave mirror along the first portion of the microwave path, and a fourth microwave mirror between the third microwave mirror and the antenna along the first portion of the microwave path. The first microwave mirror and the fourth microwave mirror lie along an azimuthal rotation axis, and the second microwave mirror and the third microwave mirror lie off the azimuthal rotation axis. The fourth microwave mirror lies along an elevational rotation axis lying perpendicular to the azimuthal rotation axis. An azimuthal rotation drive rotates the first microwave mirror, the second microwave mirror, the third microwave mirror, and the fourth microwave mirror as a unit about the azimuthal rotation axis. An elevational rotation drive rotates the fourth microwave mirror about the elevational rotation axis, permitting elevational aiming of the microwave output beam.

In another application, a guide mirror drive is operably connected to the at least one guide microwave mirror to change the position of the at least one guide microwave mirror, as by tilting. A controller has as an input a signal from the light sensor and as an output a command signal to the guide mirror drive. Active control of the controlled mirror is used to maintain the microwave beam pointed at a selected target region.

The present invention provides an important advance in the aiming of microwave antenna systems. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
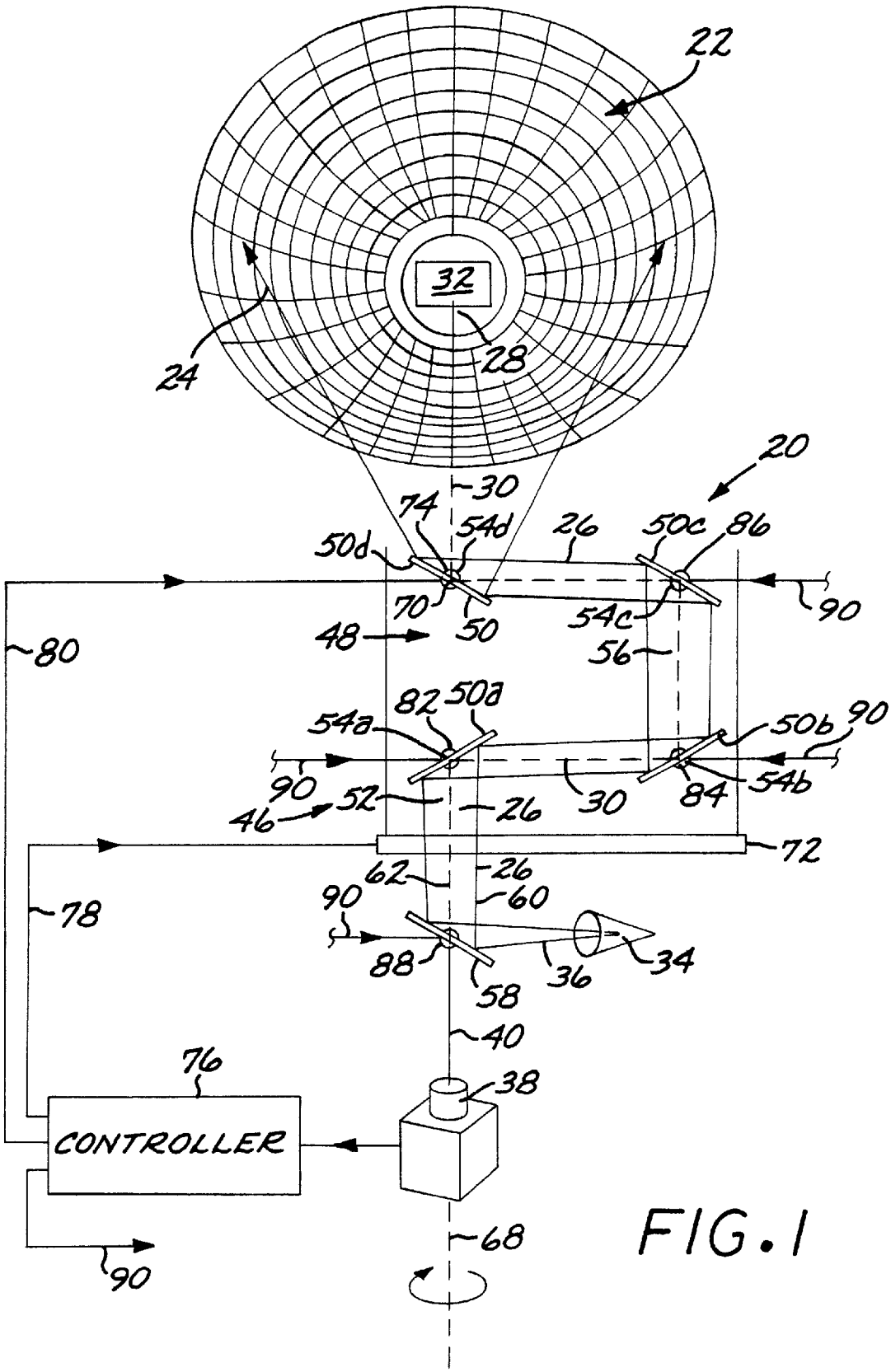
FIG. 1 is a schematic side view of a microwave antenna and light tracking system according to the invention.
Figure 2:
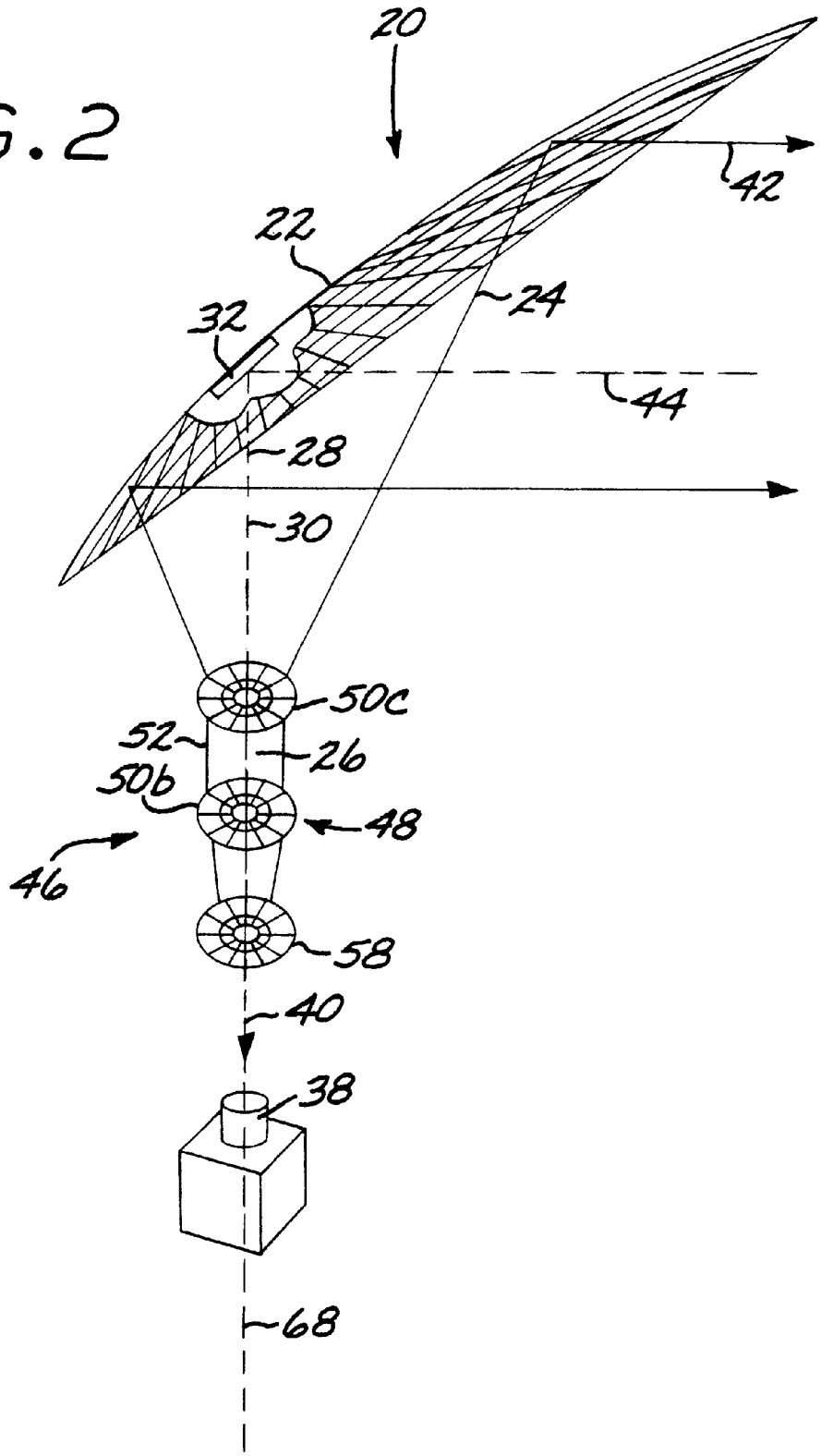
FIG. 2 is a schematic front view of the microwave antenna and light tracking system of FIG. 1.

FIGS. 1 and 2 depict a microwave antenna and light tracking system 20. The system 20 includes a microwave antenna 22 at a first end 24 of a microwave path 26 and at a first end 28 of a light path 30. The microwave antenna 22 may be of any operable type, and is here pictured as having a main reflector. The invention is also operable with a cassegrain-type antenna having a subreflector, and with other types of microwave antennas. For the antenna configuration of FIGS. 1 and 2, the antenna 22 includes a light mirror 32 thereon, positioned to intercept the light path 30. For other antenna configurations, the light path may extend through the antenna so that no light mirror 32 is required. The term "light" herein refers to light of any frequency, including ultraviolet, visible, and infrared light.

A microwave transmit/receive device 34 is positioned at a second end 36 of the microwave path 26. As used herein, the term "transmit/receive device", whether applied to a microwave transmit/receive device or a light transmit/receive device, means that the device may be a transmitting (sending) device, a receiving device, or both a transmitting and receiving device. In the pictured preferred application, the microwave transmit/receive device 34 is a microwave transmitter, most preferably a microwave feed horn. The microwave transmit/receive device 34 may include a microwave receiver in addition to, or instead of, the microwave transmitter.

A light transmit/receive device 38 is positioned at a second end 40 of the light path 30. The light transmit/receive device 38 is preferably a light receiver, in the form of a light sensor such as a camera or a focal plane array, that is sensitive to light of a selected wavelength. Thus, in the preferred structure, microwave energy flows from the microwave transmitter 34 to the antenna 22, and is radiated away as a microwave output beam 42. Light energy flows inwardly to the antenna 22 as a light input beam 44 and to the light sensor 38, the direction opposite to the path of the microwave energy, and is received at the light sensor. The light transmit/receive device 38 may include a light transmitter in addition to, or instead of, the light receiver.

A beam-guide system 46 is disposed in the microwave path 26 and in the light path 30. The beam-guide system 46 directs the microwave beam and the light beam between the antenna 22 and the microwave transmitter 34 and the light sensor 38, respectively. The beam-guide system 46 includes a mirror set 48 comprising at least one guide microwave mirror 50, here illustrated as four microwave mirrors 50*a*–50*d*, operable to direct the microwave beam along a first portion 52 of the microwave path 26. A preferred form of the four-mirror set of mirrors 50 will be discussed subsequently.

Each microwave mirror 50 has an associated light mirror 54, here illustrated for the preferred embodiment as four light mirrors 54*a*–54*d*, positioned to direct a light beam along a first portion 56 of the light path 30 substantially coincident with the first portion 52 of the microwave path 26. Preferably, the first portion 56 of the light path 30 is exactly coincident with the first portion 52 of the microwave path 26. In other cases, there may be a slight lateral displacement between the two paths 26 and 30 for geometrical reasons, such as when the light path 30 must be slightly laterally displaced from the microwave path 26 to avoid a portion of the structure of the antenna 22 (such as a secondary reflector).

Figure 3:
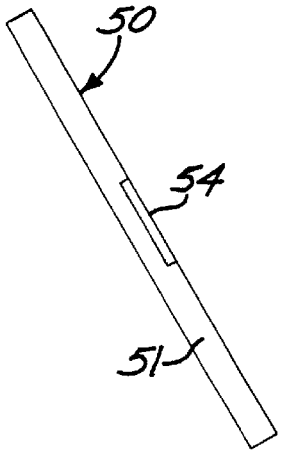
FIG. 3 is a side elevational view of a microwave/light mirror.

FIG. 3 illustrates one of the microwave mirrors 50 and the light mirrors 54 in greater detail, and this same structure may be used for all of the microwave mirrors 50*a*–50*d* and light mirrors 54*a*–54*d*. The microwave mirror 50 is made of a piece 51 made of a material that is a good reflector of microwave energy. Metals such as aluminum are preferably used as the microwave mirror 50. The light mirror 54 is made of a material that is a good reflector of light energy of the selected wavelength, and such materials are known in the art. For visible light, for example, the light mirror 54 may be glass which is metallized with silver on one side. The light mirror 54 is affixed to the surface of the microwave mirror 50, preferably in about its center, or it may be recessed into the surface of the microwave mirror 50 (as illustrated), either of which structures is included within the scope of the term "embedded". The microwave mirror 50 and the light mirror 54 are illustrated as flat mirrors, but they may be concavely curved. If the microwave mirror 50 is curved, the light mirror 54 is curved with the same curvature as the microwave mirror 50. If the light mirror 54 and the microwave mirror have the same shape, there is no microwave degradation, and the size of the light mirror 54 is not of concern from the standpoint of microwave performance. However, the light mirror 54 is preferably of as small a size as possible, in order to facilitate its manufacture.

A dichroic beam splitter 58 is disposed in a second portion 60 of the microwave path 26 between the mirror set 48 and the microwave transmit/receive device 34. The second portion 60 of the microwave path 26 is reflected from the dichroic beam-splitter 58. The dichroic beam splitter 58 is also disposed in a second portion 62 of the light path 30 between the mirror set 48 and the light transmit/receive device 38. The second portion 62 of the light path 30 is transmitted through the dichroic beam splitter 58.

Figure 4:
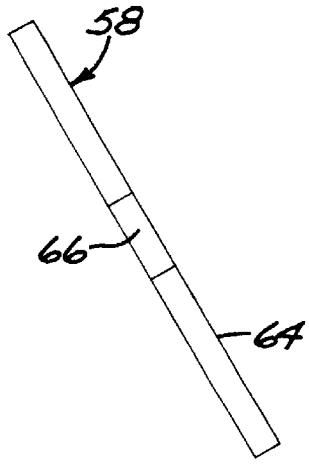
FIG. 4 is a schematic side sectional view of a microwave/light dichroic beam splitter.

The dichroic beam splitter 58 is a device which reflects energy in one wavelength range, here the microwave range of about 0.8–100 GHz, and transmits energy in another range, here the frequency of light. Dichroic beam splitters 58 are known for various combinations of frequencies that are to be processed. A preferred form of the dichroic beam splitter 58 is illustrated in FIG. 4. The dichroic beam splitter 58 is a flat metal plate 64, such as an aluminum plate, that reflects microwave energy. A window 66 that is transparent to the selected type of light is embedded in the plate 64 and extends through the plate 64. The window 66 may be a material that is transparent to the selected type of light, and such materials are known in the art. For visible light, the window 66 may be glass or quartz. The window 66 may also be an unfilled aperture through which the light beam passes. The window 66 is preferably in as small a size as possible, in order not to interfere with the reflection of the microwaves by the metal plate 64. Preferably, the window 66 has a size of less than one microwave wavelength.

Figure 5:
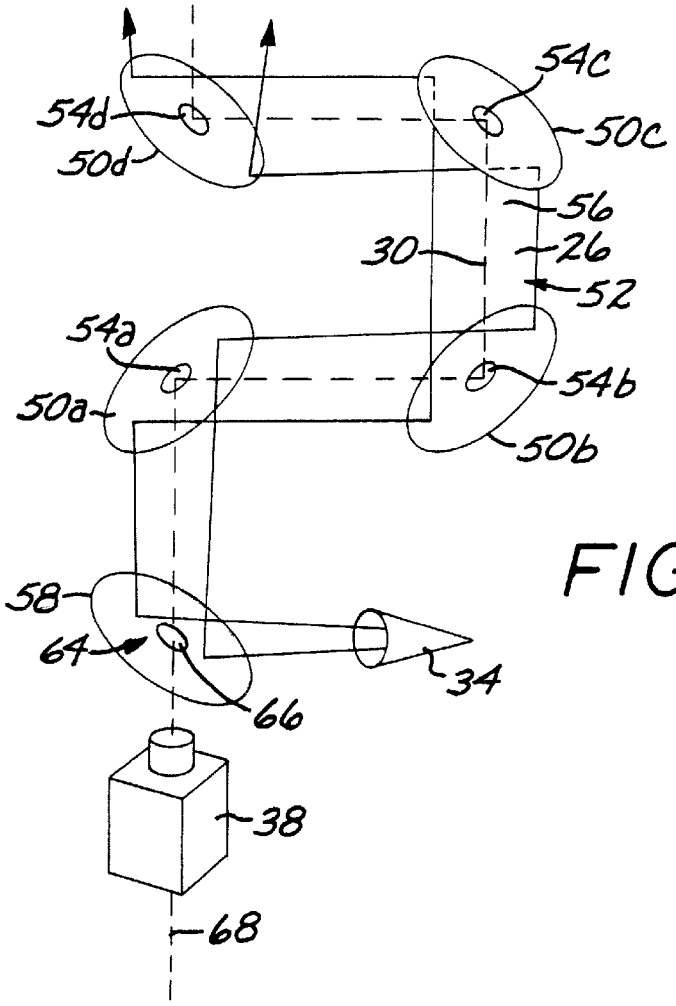
FIG. 5 is a schematic perspective view of a portion of the microwave antenna and light tracking system, illustrating the structure of the mirrors, and the microwave and light ray paths.

In a preferred embodiment illustrated in FIGS. 1, 2, and 5, the mirror set 48 comprises at least four microwave waveguide mirrors selected to shape the microwave path 26 to permit axial and azimuthal pointing of the beam. A first microwave mirror 50*a*, which is preferably flat, is adjacent to the dichroic beam splitter 58 along the first portion 52 of the microwave path 26; a second microwave mirror 50*b* is adjacent to the first microwave mirror 50*a* along the first portion 52 of the microwave path 26; a third microwave mirror 50*c* is adjacent to the second microwave mirror 50*b* along the first portion 52 of the microwave path 26; and a fourth microwave mirror 50*d* is between the third microwave mirror 50*c* and the antenna 22 along the first portion 52 of the microwave path 26.

In this preferred configuration, the first microwave mirror 50*a* and the fourth microwave mirror 50*d* lie along an azimuthal rotation axis 68, and the second microwave mirror 50*b* and the third microwave mirror 50*c* lie off and are laterally displaced from the azimuthal rotation axis 68. The dichroic beam splitter 58 also lies along the azimuthal axis 68. The fourth microwave mirror 50*d* is pivotably mounted to rotate about an elevational rotation axis 70 lying perpendicular to the azimuthal rotation axis 68. There is desirably an azimuthal rotation drive 72 for rotating the first microwave mirror 50*a*, the second microwave mirror 50*b*, the third microwave mirror 50*c*, the fourth microwave mirror 50*d*, and, optionally, the dichroic beam splitter 58 as a unit about the azimuthal rotation axis 68. There is also desirably an elevational rotation drive 74 for rotating the fourth microwave mirror 50*d* about the elevational rotation axis 70.

The utilization of the apparatus of the invention depends upon whether microwaves are received and/or transmitted, and light is received and/or transmitted. In the preferred application as described above, the microwave transmit/receive device 34 is a microwave source in the form of the feed horn, and the light transmit/receive device 38 is the light sensor. The path of the microwave output beam 42 is aimed at the same location as the central target region of the light input beam sensed by the light sensor, so that the invisible microwave beam is aimed using the light beam. If the mirrors 50 are or become misaligned for any reason, that misalignment will equally affect the microwave path 26 and the light path 30. The aiming of the microwave output beam 42 will therefore remain true in the sense that the microwave output beam 42 will always remain pointed at the location indicated by the light input beam 44.

The present approach may also be used in an active feedback mode to aim the microwave output beam 42 and to correct alignment errors in the mirrors 50, using additional features shown in FIG. 1. A controller 76 receives an input from the light transmit/receive device 38, which in this case is the light sensor. The controller 76 provides an output command signal 78 to the azimuthal rotational drive 72 and an output command signal 80 to the elevational rotational drive 74. Additionally, the mirrors 50*a*, 50*b*, and 50*c*, and the dichroic beam splitter 58 may be provided with rotational drives 82, 84, 86, and 88, respectively. (The drives 74, 82, 84, and 86 are collectively termed the "guide mirror drives".) The controller 76 provides output command signals to these drives 82 84, 86, and 88, indicated collectively as output command signal 90, as well as the output command signals 78 and 80. If the controller 76 senses a change in alignment through the unintended shifting or distortion of the light image on the sensor 38, one or more of the command signals 78, 80, and/or 90 may be used to operate one or more of the drives 72, 74, 82, 84, 86, or 88 to correct the shift or the distortion.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave antenna and light tracking system, comprising:

a microwave antenna at a first end of a microwave path and at a first end of a light path;

a microwave transmit/receive device at a second end of the microwave path;

a light transmit/receive device at a second end of the light path; and a beam-guide system disposed in the microwave path and in the light path, the beam-guide system comprising a mirror set comprising at least one guide microwave mirror operable to direct a microwave beam along a first portion of the microwave path, each microwave mirror having associated therewith a light mirror positioned to direct a light beam along a first portion of the light path substantially coincident with the first portion of the microwave path, and a dichroic beam splitter disposed in a second portion of the microwave path between the mirror set and the microwave transmit/receive device, wherein the second portion of the microwave path is reflected from the dichroic beam-splitter, and in a second portion of the light path between the mirror set and the light transmit/receive device, wherein the second portion of the light path is transmitted through the dichroic beam splitter.

2. The microwave antenna and light tracking system of claim 1, wherein the microwave antenna comprises a main reflector.

3. The microwave antenna and light tracking system of claim 1, wherein the microwave transmit/receive device comprises a microwave transmitter.

4. The microwave antenna and light tracking system of claim 1, wherein the microwave transmit/receive device comprises a microwave feed horn.

5. The microwave antenna and light tracking system of claim 1, wherein the light transmit/receive device comprises a light sensor.

6. The microwave antenna and light tracking system of claim 1, wherein each microwave mirror has the light mirror embedded therein.

7. The microwave antenna and light tracking system of claim 1, wherein the dichroic beam splitter comprises a microwave beam-splitter mirror having embedded therein a light-transparent window.

8. The microwave antenna and light tracking system of claim 1, wherein the mirror set comprises four microwave waveguide mirror mirrors, including a first microwave mirror adjacent to the dichroic beam splitter along the first portion of the microwave path, a second microwave mirror adjacent to the first microwave mirror along the first portion of the microwave path, a third microwave mirror adjacent to the second microwave mirror along the first portion of the microwave path, and a fourth microwave mirror between the third microwave mirror and the antenna along the first portion of the microwave path, and wherein the first microwave mirror and the fourth microwave mirror lie along an azimuthal rotation axis, and the second microwave mirror and the third microwave mirror lie off the azimuthal rotation axis.

9. The microwave antenna and light tracking system of claim 8, further including an azimuthal rotation drive for rotating the first microwave mirror, the second microwave mirror, the third microwave mirror, and the fourth microwave mirror as a unit about the azimuthal rotation axis.

10. The microwave antenna and light tracking system of claim 8, further including an elevational rotation drive for rotating the fourth microwave mirror about an elevational rotation axis lying perpendicular to the azimuthal rotation axis.

11. The microwave antenna and light tracking system of claim 1, wherein the light transmit/receive device is a light sensor, and the further including a guide mirror drive operably connected to the at least one guide microwave mirror to change the position of the at least one guide microwave mirror, and a controller having as an input a signal from the light sensor and as an output a command signal to the guide mirror drive.

12. A microwave antenna and light tracking system, comprising:

a microwave antenna;

a microwave source;

a light sensor;

a beam-guide system comprising a mirror set comprising at least one guide microwave mirror operable to guide a microwave beam along a first portion of a microwave path toward the antenna, each microwave mirror having embedded therein a light mirror positioned to direct a light beam along a first portion of a light path substantially coincident with the first portion of the microwave path but in a reverse direction from the antenna, and a dichroic beam splitter comprising a dichroic beam splitter microwave mirror having a light-transparent window therethrough, the dichroic beam splitter being disposed in a second portion of the microwave path between the mirror set and the microwave transmit/receive device and in a second portion of the light path between the mirror set and the light sensor, wherein the microwave source is positioned to direct a microwave signal to the dichroic beam splitter, whereupon the microwave signal is reflected along the second portion of the microwave path to the mirror set and thence to the antenna, and wherein the light sensor is positioned to receive light transmitted along the second portion of the light path through the light-transparent window of the dichroic beam splitter.

13. The microwave antenna and light tracking system of claim 12, wherein the microwave source is a microwave feed horn.

14. The microwave antenna and light tracking system of claim 12, wherein the mirror set comprises four microwave waveguide mirrors, including a first flat microwave mirror adjacent to the dichroic beam splitter along the first portion of the microwave path, a second microwave mirror adjacent to the first flat microwave mirror along the first portion of the microwave path, a third microwave mirror adjacent to the second microwave mirror along the first portion of the microwave path, and a fourth flat microwave mirror between the third microwave mirror and the antenna along the first portion of the microwave path, and wherein the first flat microwave mirror and the fourth flat microwave mirror lie along an azimuthal rotation axis, and the second microwave mirror and the third microwave mirror lie off the azimuthal rotation axis.

15. The microwave antenna and light tracking system of claim 14, further including an azimuthal rotation drive for rotating the first flat microwave mirror, the second microwave mirror, the third microwave mirror, and the fourth flat microwave mirror as a unit about the azimuthal rotation axis.

16. The microwave antenna and light tracking system of claim 14, further including an elevational rotation drive for rotating the fourth flat microwave mirror about an elevational rotation axis lying perpendicular to the azimuthal rotation axis.

17. The microwave antenna and light tracking system of claim 13, wherein the light transmit/receive device is a light sensor, and the further including a guide mirror drive operably connected to the at least one guide microwave mirror to change the position of the at least one guide microwave mirror, and a controller having as an input a signal from the light sensor and as an output a command signal to the guide mirror drive.

* * * * *